US006989632B2

(12) United States Patent
Bach et al.

(10) Patent No.: US 6,989,632 B2
(45) Date of Patent: Jan. 24, 2006

(54) PHOTOMULTIPLIER

(75) Inventors: Anthony Bach, Perivale (GB); Ron McAlpine, Uxbridge (GB)

(73) Assignee: Electron Tubes Limited, Middlesex (GB)

( * ) Notice: Subject to any disclaimer, the term of this patent is extended or adjusted under 35 U.S.C. 154(b) by 76 days.

(21) Appl. No.: 09/997,696

(22) Filed: Nov. 30, 2001

(65) Prior Publication Data

US 2002/0079838 A1 Jun. 27, 2002

(30) Foreign Application Priority Data

Dec. 1, 2000 (GB) ..... 0029382

(51) Int. Cl.

| | |
|---|---|
| ***H01J 43/18*** | (2006.01) |
| ***H01J 43/04*** | (2006.01) |
| ***H01J 43/20*** | (2006.01) |
| ***H01J 40/14*** | (2006.01) |

(52) U.S. Cl. ..... 313/533; 313/523; 313/532; 313/534; 313/103 R; 250/207

(58) Field of Classification Search ..... 313/523, 313/533, 534, 103 R, 532; 250/207
See application file for complete search history.

(56) References Cited

U.S. PATENT DOCUMENTS

| | | | | |
|---|---|---|---|---|
| 2,187,184 A | | 1/1940 | Siebertz | |
| 3,436,590 A | | 4/1969 | Wolfgang et al. | |
| 3,619,692 A | | 11/1971 | Day | |
| 4,164,681 A | | 8/1979 | Catanese | |
| 4,182,969 A | | 1/1980 | Catanese | |
| 4,687,921 A | * | 8/1987 | Kojola | 313/532 |
| 4,825,066 A | | 4/1989 | Nakamura et al. | |
| 4,937,506 A | * | 6/1990 | Kimura et al. | 313/533 |
| 5,633,562 A | * | 5/1997 | Okano et al. | 313/532 |
| 6,384,519 B1 | * | 5/2002 | Beetz et al. | 313/534 |

FOREIGN PATENT DOCUMENTS

| | | | |
|---|---|---|---|
| GB | 1172304 | | 11/1969 |
| GB | 2012475 | | 7/1979 |
| GB | 2149202 | | 6/1985 |
| GB | 2171841 A | | 9/1986 |
| JP | 5673854 | | 8/1981 |
| JP | 6378448 A | * | 8/1988 |

OTHER PUBLICATIONS

S. Inaba: A Trial Construction Of A Secondary Electron Multiplier With Ring-Shaped Dynodes; Scientific Instruments, 60 (4), Apr. 1989; pp. 805 and 806.

* cited by examiner

*Primary Examiner*—Nimeshkumar D. Patel
*Assistant Examiner*—Sharlene Leurig
(74) *Attorney, Agent, or Firm*—Hodgson Russ LLP

(57) ABSTRACT

A photomultiplier has a dynode cascade arranged radially rather than axially. Effective dynode area thereby can increase through the cascade, leading to improved linearity of response, and the axial length of the device can be reduced. The dynodes are sections of a set of toroids and may be formed as a layer of secondary emissive material such as caesiated antimony on a monolithic sintered cast or otherwise moulded or machined block of insulating material. This novel form of dynode construction can also be used in other photomultiplier or electron multiplier configurations.

6 Claims, 5 Drawing Sheets

PHOTOMULTIPLIER

This invention relates to photomultipliers, and in some aspects other electron multiplying devices.

Photomultipliers are extremely sensitive light detectors providing a current output proportional to light intensity. They are used to measure many processes which directly or indirectly emit light and are widely applied throughout science and industry A conventional photomultiplier is shown in section in FIG. 1. It consists of an evacuated glass tube 10 having at one end a window 12 through which light eg. from a source 14 is incident on a photocathode 16 causing it to emit electrons. Spaced axially in the tube from the photocathode are focusing electrodes 18 which focus the electrons on the first of a cascade of dynodes 20. Subsequent dynodes receive electrons from the preceding dynode and emit many times (eg. 5 to 10 times) more secondary electrons towards the succeeding dynode. An anode 22 collects the electrons from the last dynode of the cascade. A voltage source (not shown) maintains the focusing electrodes, the dynodes and the anode at successively increasing positive potentials relative to the cathode. Connector pins 24 transfer the potentials and provide a means of extracting the output current from the anode.

A disadvantage of such known photomultipliers is that the high gain per dynode stage results in the downstream dynodes becoming saturated when relatively high levels of light are incident on the photocathode. They then are unable to produce the same electron multiplication as the upstream dynodes. The overall gain of the photomultiplier thus is dynamically reduced, and the response characteristic of the device (output current -vs- incident light intensity) becomes non-linear.

Another disadvantage is that the photomultiplier is of considerable axial length, in order to accommodate the dynode cascade. This places constraints on the manner in which the photomultiplier may be housed, and the shape of equipment containing it.

A further disadvantage of known photomultipliers (and indeed other electron multiplying devices) is that the dynodes individually require accurate alignment (e.g. by special-to-product jigs and tools) during assembly. This adds to the manufacturing cost, and inaccuracies may lead to unwanted performance variations between nominally identical photomultipliers.

It is an object of at least the preferred embodiments of this invention to avoid or reduce at least some of the foregoing disadvantages.

In one aspect, the invention provides a photomultiplier comprising a plurality of dynodes arranged in cascade so that the second and any subsequent dynodes each receive electrons from the preceding dynode, the dynodes being of curvilinear cross-section and arcuate in extent about a common axis, successive dynodes being disposed so that the cascade extends radially relative to said axis.

In some embodiments, successive dynodes are disposed successively radially outwardly of each other, or successively radially inwardly of each other, relative to said axis.

Preferably a said curvilinear cross-section comprises an arcuate portion and a straight portion extending tangentially therefrom.

Preferably the curvilinear cross-sections of the dynodes are sections through a set of toroidal surfaces having a common principal axis of rotation each intersected by one of a set of conical surfaces coaxial with the principal axis of rotation of the toroidal surfaces.

The dynodes may be annular or part-annular or segmented.

In a radially-outwardly propagating photomultiplier, the effective area of each of at least some of the dynodes may be greater than that of the preceding one. Thus each dynode may be disposed radially outwardly of the preceding one from which it receives electrons.

If the dynodes are of the same crosssectional dimensions then the effective area of the dynodes may increase linearly with radius from dynode to dynode. However, as a variant of the preferred embodiment, advantages may be obtained by adopting a different relationship. For example if steps are taken to limit the size of the last dynode (or the last few dynodes), it is possible to make a saturating device for photon counting, where a single photon would produce an electron avalanche that would saturate a last dynode which in area is no larger than (or even smaller than) a preceding one. This would effectively give a binary signal of zero for no photon and full scale deflection in the presence of a photon, thereby effectively digitising the photon stream.

Analogously, in another form of photon counter, successive dynodes may be arranged radially inwardly of each other; the dynodes then successively are of reducing area (eg. in a linearly-reducing relationship), and saturated in the later stages.

Preferably, the dynodes are arranged in two coaxial substantially planar disc-like arrays arranged parallel to, and facing each other, whereby electrons pass successively from a dynode in one array to a dynode in the other array.

In another embodiment, at least alternate dynodes are spaced from each other successively along said axis. Thus successive dynodes may be alternately disposed on coaxial male and female generally conical surfaces.

At least one of the dynode arrays may form part of the vacuum envelope of the device.

Focusing means for the electrons may be provided integrally with one of the dynode arrays.

The device may comprise an annular, part annular or segmented anode for receiving electrons from the last dynode.

The anode may be disposed between the dynode arrays

The support structure of the anode may be of thin section whereby to reduce anode capacitance.

A plurality of the dynodes may be respective layers of a secondary emissive material deposited directly or indirectly on shaped surfaces of a common substrate of insulating material.

The invention also provides a dynode assembly for a photomultiplier or other electron multiplying device comprising at least two dynodes electrically isolated from each other, said at least two dynodes comprising discrete layers of secondary emissive material on shaped surfaces of a common substrate of insulating material.

The substrate may be machined, cast, sintered or otherwise of moulded construction.

The secondary emissive layers may be deposited on a conductive underlayer. Secondary emissive layers known to those versed in the art may be used (eg. caesiated antimony, beryllium oxide gallium phosphide etc.).

The conductive underlayer may be extended as a conductive track to form an electrical connection for the dynode.

A said electrical connector may be embedded in the insulating substrate.

The invention also provides a photomultiplier or other electron multiplying device having a dynode assembly as set forth above.

The invention will now be described merely by way of example with reference to FIGS. 2 to 9 of the accompanying drawings. In the drawings:

FIG. 1, as already described shows a conventional photomultiplier.

Figures 4A, 4B, 4C:
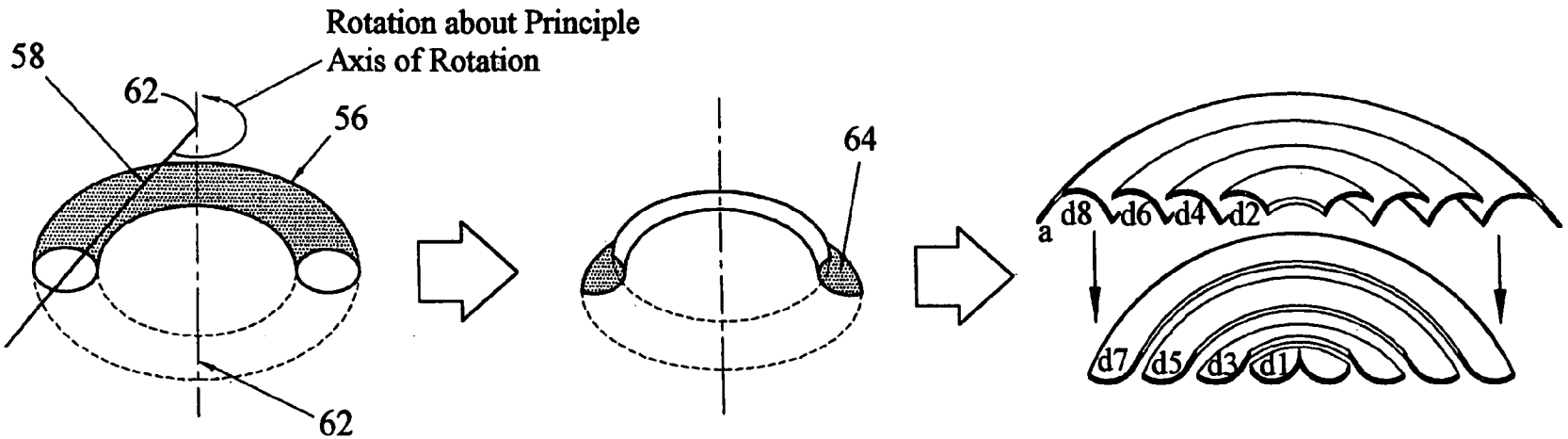
Figure 9:
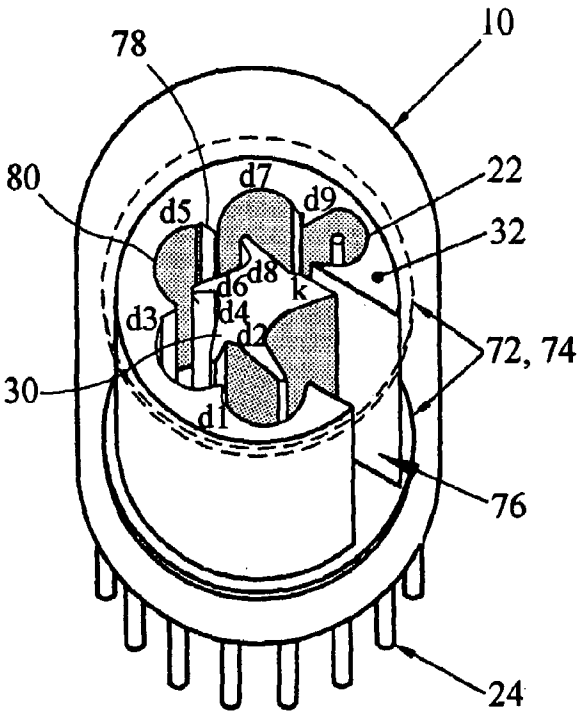
Figure 5:
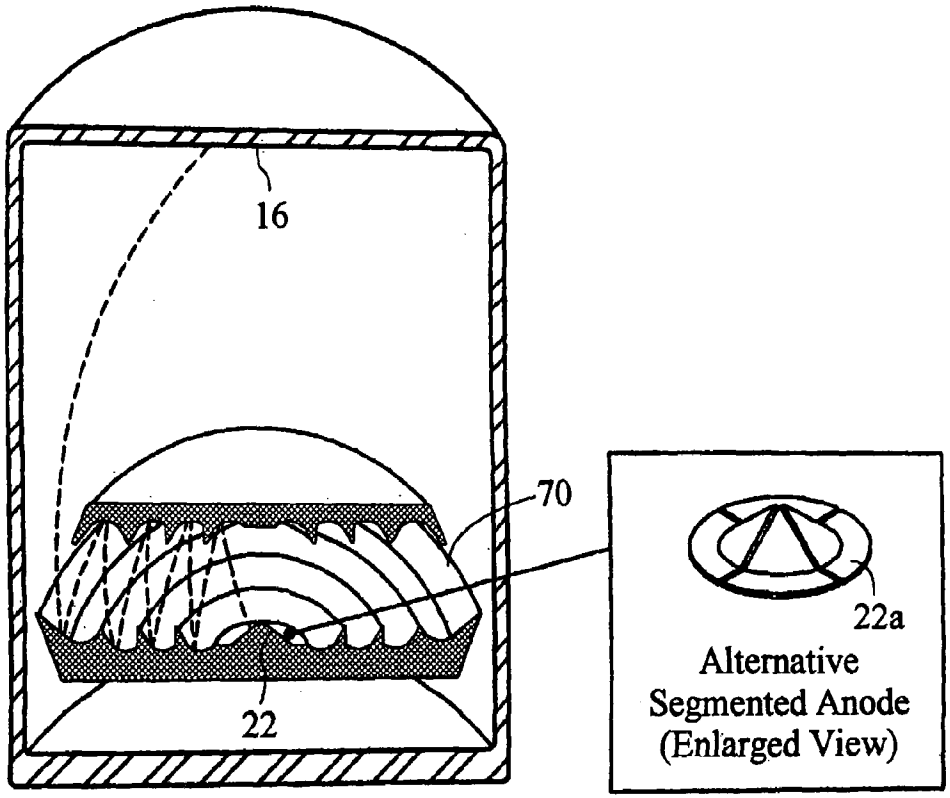
Figure 7:
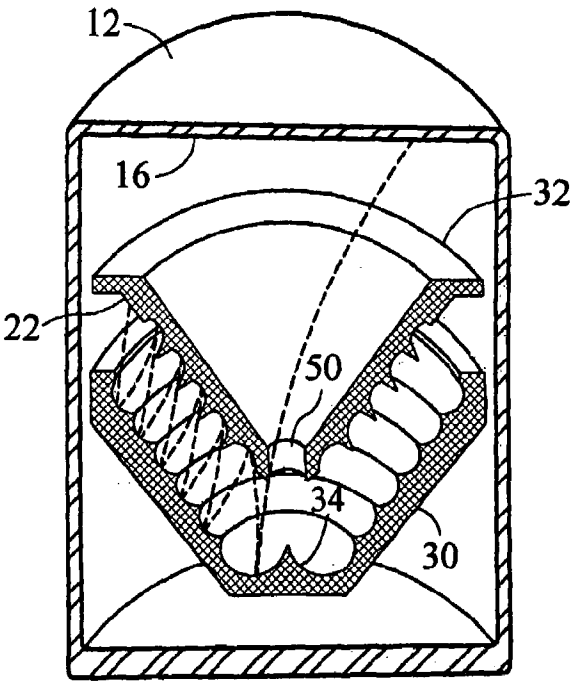
Figure 6:
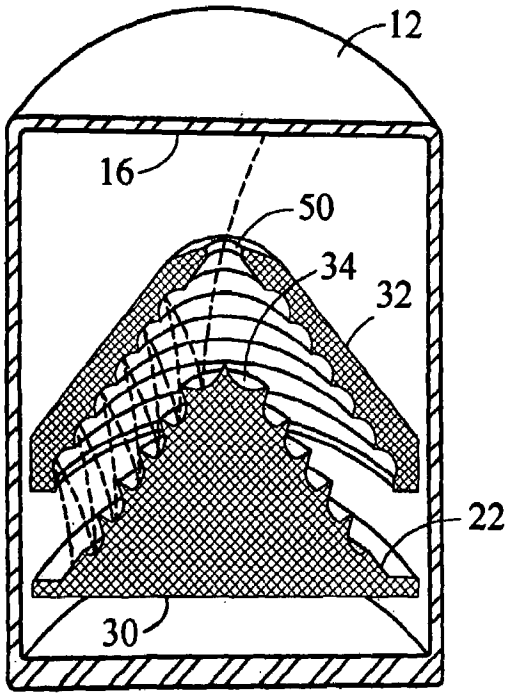
Figure 8:
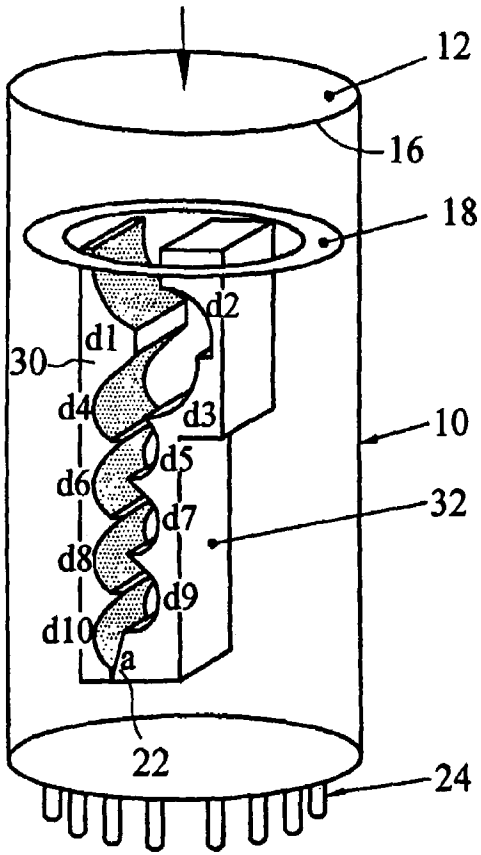

FIGS. 4*a*, 4*b* and 4*c* illustrate the generation of dynode shapes;

FIGS. 5, 6 and 7 show other photomultipliers according to the invention; and FIGS. 8 and 9 show photomultipliers according to another aspect of the invention.

Figures 2, 3:
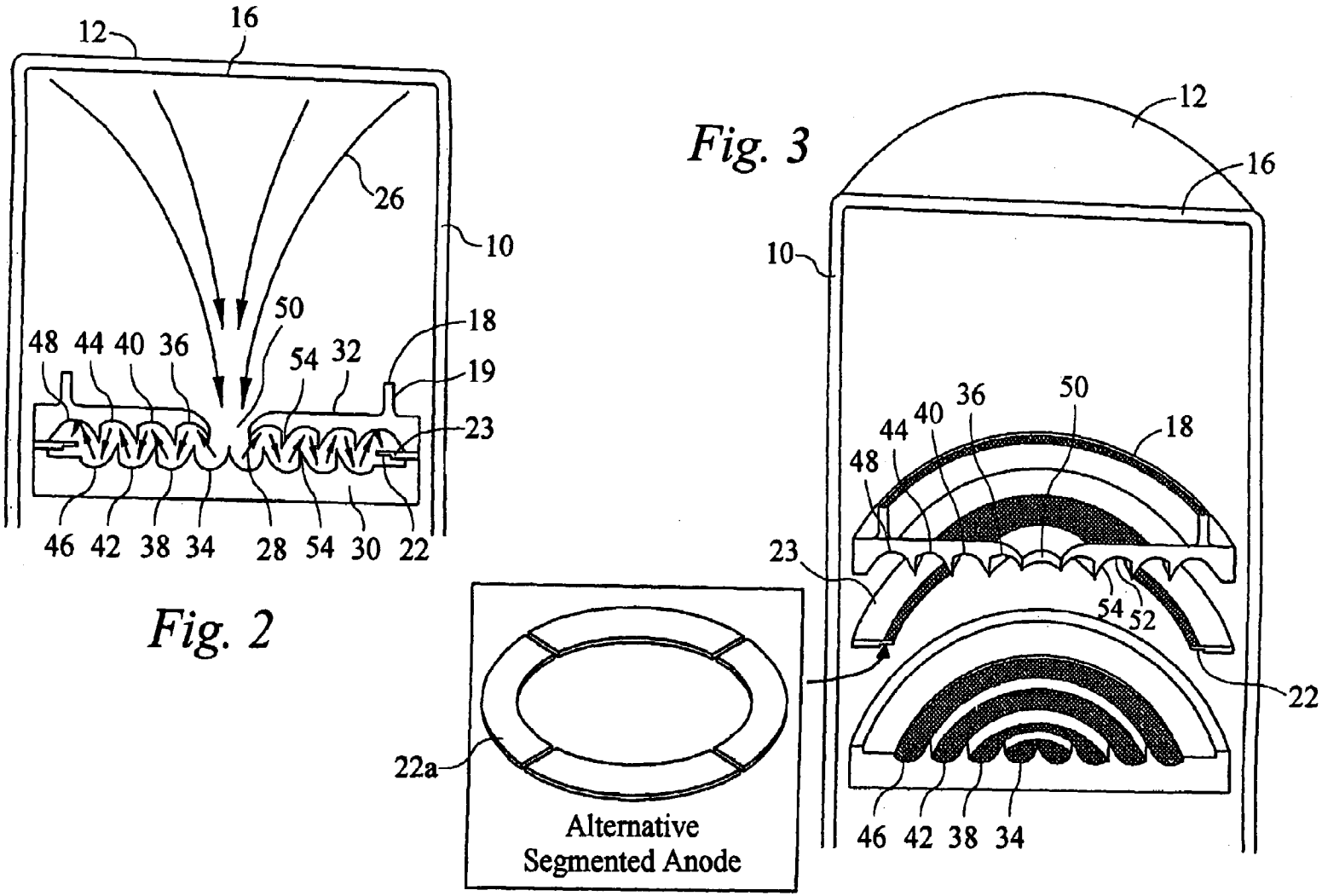
FIG. 2 is a diagrammatic section through a photomultiplier of the invention.
FIG. 3 is an exploded perspective view of the photomultiplier of FIG. 1.

Referring to FIGS. 2 and 3, a photomultiplier consists of an evacuated envelope 10, window 12, photocathode 16, ring-shaped focusing electrode 18 (more than one focusing electrode may be provided), dynodes described hereafter, anode 22 and a connector pin array (not shown).

The dynodes are annular in shape and are curvilinear in radial cross-section. They are arranged alternately in two planar disc-like arrays 30,32. The first dynode 34 is at the centre of array 30, the next 36 radially outwardly thereof in array 32, the following one 38 in array 30, and so on to the radially outermost dynode, which could be in either array, depending on the number of stages that it is chosen to use. The cascade of dynodes thus progresses radially outwards. Array 32 has a central aperture 50 to permit photoelectrons 26 (focused by the focusing electrode 18) to impinge on the first dynode 34. The anode 22 is annular and disposed radially outwardly of the final dynode 48, to receive secondary electrons therefrom. The anode is formed on an inner (thinner) part of an insulating disc 23 the main body of which is of a thickness chosen to achieve the correct spacing between the dynode arrays 30, 32. The anode 22 is formed by a conductive layer on the top surface and edges of the inner part of the disc 23. The thickness-to-volume ratio of this inner part supporting the anode is reduced as far as practicable, in order to reduce the capacitance of the anode.

A conductive track is taken from the anode to the outer edge of the disc 23 for connection to one of the pins 24. The anode may be segmented into a number of separate sections, as shown at 22*a*. This enables the photomultiplier to provide an output which indicates where around the polar axis of the device the photons are incident on the cathode 16. If desired, the dynodes can be similarly segmented with radially-extending isolating walls between the segments. This can improve the differentiation between the outputs of the anode segments.

The dynode arrays 30,32 can be integrally formed in machined or pressed and sintered ceramic material which is one structure permitting ease of assembly. Another suitable structure is metal rings separated by insulating supports. The active surfaces of the dynodes are coated with secondary emissive material such as beryllium oxide or caesiated antimony, as known per se.

The anode, the dynodes and the focusing electrode are biased relative to the cathode by a conventional voltage divider network, In operation, photoelectrons 26 enter the aperture 50 and strike the first dynode 34. Secondary electrons 28 are produced and directed to the next dynode 36, where the process is repeated and the electrons directed to the next dynode 38 until dynode 48 delivers the electrons (typically of the order of $10^6$ secondary electrons per photoelectron) to the anode 22.

In the preferred embodiment the effective area of the dynodes inherently increases from one dynode to the next. Assuming the case where they are all of the same cross-sectional shape and of constant radial width, the increase in effective area from dynode to dynode is a function of the radial distance of the dynode from the centre. The design is not limited however to the case where the radial width and cross-sectional area are fixed from dynode to dynode.

The increase in area enables saturation of the downstream dynodes to be minimised, and with suitable selection of the relative electrode potentials using known techniques, substantial linearity of the photomultiplier across its working range can be maintained, if desired. Alternatively decreasing the active area on the later dynodes allows deliberate saturation to be achieved where this is desirable for a specific application (eg. photon counting).

Compared to conventional designs, the axial length of the photomultiplier can be substantially reduced.

When the arrays 30, 32 are sintered or pressed, the substrate material may advantageously be borosilicate glass powder or alumina, held together by a suitable binder such as nitrocellulose and baked at about 1000° C. The substrate is then suitably masked, and a conducting layer, for example aluminium, is deposited where the field-forming and active dynode areas are required. These conductive dynode areas are subsequently coated with a precursor for example antimony which will later be activated with alkali metals to form the secondary emissive layer. Embedded pins may be provided to make electrical contact to these active dynode areas. Optionally additional conductive tracks may be provided from those areas to connector pins passing through the base of the envelope 10 for engagement with a suitable socket. In the case of the lower array 30, bores may be provided in which the connector pins are directly embedded, the tracks then including metal plating on the inner surfaces of the bores.

Thus the dynode array 30 can be used to form the end-seal of the tube, in which case the connector pins for the cathode 16, focusing electrode 18 and anode 22 may also be set into the insulating material of the dynode array 30. Alternatively or in addition the periphery of the dynode structure may be extended to form the side wall of the tube. A rugged and low-cost device thereby can be achieved.

Also, the dynode array structure provides a convenient means of mounting one or more focusing electrodes. As can be seen from FIG. 2, the electrode 18 is carried by a projecting ring 19 formed integrally with dynode array 32.

The cross-sectional shape or profile of the dynodes is important for the efficient functioning of the photomultiplier. It must gather electrons emitted by the preceding dynode and launch a much larger number towards the next dynode. Generally electrons are launched normal to the local dynode surface on which the received electron is incident, regardless of the angle of incidence of the incident electron.

Furthermore excessive variations in transit time within the device desirably should be avoided. Ideally an instantaneous pulse of light striking the photocathode should produce an impulse response at the output of the photomultiplier, but in practice a more or less sharp pulse is produced, depending on differences in transit time or path length of the many electrons produced in the device.

Additionally it is desirable to provide masks or barriers between the dynodes so that there is less opportunity for ions or photons generated by electron impact to pass back to preceding stages. Such positive feedback is a known cause of afterpulses and limits the maximum multiplier gain.

For ease of manufacture the active surfaces of the dynodes can advantageously be defined in radial cross-section by an arcuate portion with a generally straight portion extending tangentially therefrom, as shown in FIG. 3 at 52, 54 respectively for a typical dynode.

FIGS. 4*a* to 4*c* show how a compatible set of annular dynode profiles is generated. The dynode radial cross-sections are defined by hollow toroidal surface 56 of the required cross-section. The cross-section here shown may be elliptical or spiral in its relevant parts as an alternative to the previously mentioned arc plus tangent profile 52, 54, such profiles also having been found satisfactory in some circumstances. The dynode section is defined by rotation of a line 58 about a point 60 on the axis of rotation 62 of the toroid so as to form a cone intersecting the toroid. The active dynode surface which results is shown at 64 in FIG. 4*b*. Dynodes of different radii are obtained by increasing or decreasing the radius of the toroid moving point 60 on the axis 62 to maintain a constant angle between the line 58 and the axis 62.

Hence a half-set of dynodes $d_1$, $d_3$, $d_5$ and $d_7$ (FIG. 4*c*) can be produced from a set of toroids of increasing radius. The other half of the dynode set $d_2$, $d_4$, $d_6$, $d_8$ is produced analogously by rotating a line which is a mirror-image of line 58 in the plane of the toroid 56 about a point, on its axis of rotation 62. This half set of toroids has radii which are interpolated between those radii chosen for the first half set and again point 60 is moved similarly to maintain the angle of line 58.

The portions 54 of the dynode section gather and accelerate the electrons from the previous dynode, each dynode being at a potential typically 100 v more positive than the preceding one or the cathode (in the case of the first dynode). The portions 54 of the dynodes of one array 30 or 32 also extend sufficiently far towards the dynodes of the other array so that they provide barriers which prevent substantially any ions or photons produced at a dynode from reaching a previous stage to generate positive feedback. It will be seen from FIGS. 2 and 3 that in particular the tips of the portions 54 of neighbouring dynodes overlap so that there is no line-of-sight radially through the dynode assembly. Positive feedback thus is reduced.

When a saturated output is required or acceptable, the photomultiplier may be configured so that the electrons pass through a radially-inwardly extending cascade of dynodes. Thus in FIG. 5 electrons from the photocathode 16 strike the outermost dynode 70 and progress radially inwardly from dynode to dynode (which are successively smaller in effective area) to the anode 22. The anode may be segmented as at 22*a*, for polar resolution of the incident photons. The dynodes may also be segmented. Although the most axially compact photomultiplier is obtained from use of disc-like dynode arrays as in FIG. 3, a greater number of dynode stages can be accommodated within a given photomultiplier diameter if the dynode cascade progresses axially of the photomultiplier as well as radially.

Thus in FIG. 6*a*, a twelve-stage dynode structure is provided on two conforming male and female conical structures. The dynodes on each cone (ie. alternate dynodes in the cascade) are thus spaced successively axially from each other. The structures are shown spaced-apart axially for clarity; in practice their relative positions would be such as to impede line of-sight feedback of ions and photons as discussed with reference to FIGS. 2 and 3. A rather similar but inverted structure is shown in FIG. 7; in both FIGS. 6 and 7 the dynode arrays are formed on monolithic sintered substrates as described with reference to FIGS. 2 and 3, in a similar manner to the planar discs of FIG. 4 but with a different angle between the cut line 58 and the axis 60. Corresponding parts bear the same reference numerals as in those Figures.

Depending on the cone angle, and the particular form of the dynodes, electrons from a dynode on the outer conical surface 32 may move slightly radially inwardly to the next dynode on the inner cone 30, as shown for example in FIG. 6. However the movement from the dynode on the inner cone to those on the outer cone is markedly radially outward, and the overall progression of the cascade of dynodes thus is still radially outward. Analogously, the overall progression of the dynode cascade in FIG. 7 is always radially outward.

Figure 1:
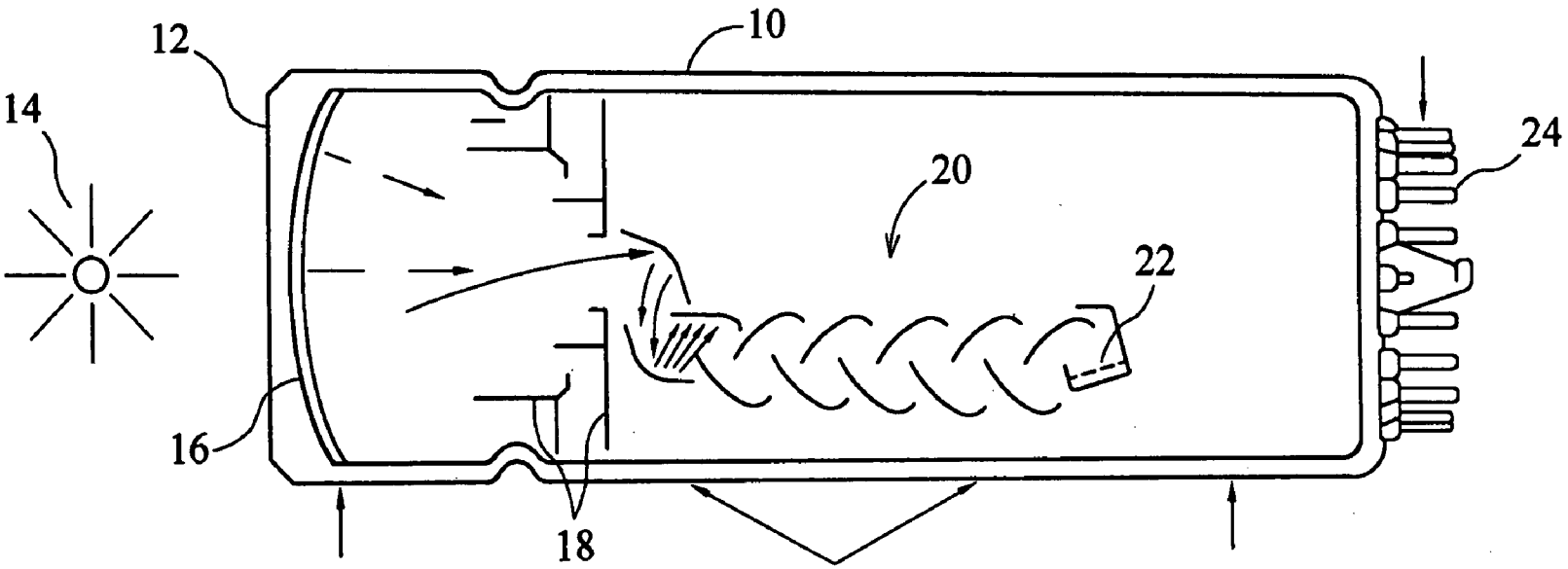
Fig. 1 Prior Art

The concept of providing two or more dynodes on a common insulating base structure can be applied to dynode structures in which the electrons do not progress radially. Thus, in FIG. 8 there are shown two sintered dynode structures each having five dynodes $d_1$–$d_9$ and $d_2$–$d_{10}$ in an axially-propagating photomultiplier similar to that shown in FIG. 1, in substitution for the conventional separate dynodes.

FIG. 9 shows a circularly-propagating photomultiplier in which two sintered dynode structures 30, 32 are located by insulating support discs 72, 74.

Light enters through window 76 in the envelope 10 and strikes the photocathode 16. Electrons thereby generated propagate successively through dynodes $d_1$–$d_9$ to an anode 22 which is in the form of a wire.

As can be best seen in FIG. 9, adjacent dynodes on the same substrate are discrete and separated from each other by an uncoated section of substrate eg, 78 between dynodes $d_5$ and $d_7$, and 80 between dynodes $d_4$ and $d_6$. The same separation between adjacent dynodes is provided in the other embodiments having a common-substrate dynode structure. It will of course be appreciated that the radial propagation from dynode to dynode can be of the first aspect of the invention realised without using the common substrate concept of the second aspect.

Each feature disclosed in this specification (which term includes the claims) and/or shown in the drawings may be incorporated in the invention independently of other disclosed and/or illustrated features.

The abstract as filed herewith is repeated here as part of the specification.

A photomultiplier has a dynode cascade arranged radially rather than axially. Effective dynode area thereby can increase through the cascade, leading to improved linearity of response, and the axial length of the device can be reduced. The dynodes are sections of a set of toroids and may be formed as a layer of secondary emissive material such as caesiated antimony on a monolithic sintered cast or otherwise moulded or machined block of insulating material. This novel form of dynode construction can also be used in other photomultiplier or electron multiplier configurations.

What is claimed is:

1. A photomultiplier comprising a plurality of dynodes arranged in cascade so that the second and any subsequent dynodes each receive electrons from the preceding dynode, the dynodes being of curvilinear cross-section and arcuate in extent about a common axis, successive dynodes being disposed so that the cascade extends radially relative to said axis, wherein a said curvilinear cross-section comprises an arcuate portion and a straight portion extending tangentially therefrom, or a part-elliptical portion or a spiral portion, wherein the dynodes are annular or part annular or segmented, and wherein the curvilinear cross-sections of the dynodes are sections through a set of toroidal surfaces having a common principal axis of rotation each intersected by one of a set of conical surfaces coaxial with the principal axis of rotation of the toroidal surfaces.

2. A photomultiplier as claimed in claim 1, wherein the effective area of each of at least some of the dynodes is greater than that of the preceding one.

3. A photomultiplier comprising a plurality of dynodes arranged in cascade so that the second and any subsequent dynodes each receive electrons from the preceding dynode, the dynodes being of curvilinear cross-section and arcuate in extent about a common axis, successive dynodes being disposed so that the cascade extends radially relative to said axis, wherein at least alternate dynodes are spaced from each other successively along said axis, and wherein successive dynodes are alternately disposed on coaxial male and female generally conical surfaces.

4. A photomultiplier comprising a plurality of discrete dynodes arranged in cascade so that the second and any subsequent dynodes each receive electrons from the preceding dynode, the dynodes being of curvilinear cross-section and arcuate in extent about a common axis, successive dynodes being disposed so that the cascade extends radially relative to said axis, wherein the dynodes are arranged in two coaxial substantially planar substantially disc-shaped arrays arranged parallel to and facing each other, and wherein the effective area of each of at least some of the dynodes is less than that of the preceding one.

5. A photomultiplier comprising a plurality of discrete dynodes arranged in cascade so that the second and any subsequent dynodes each receive electrons from the preceding dynode, the dynodes being of curvilinear cross-section and arcuate in extent about a common axis, successive dynodes being disposed so that the cascade extends radially relative to said axis, wherein the dynodes are arranged in two coaxial substantially planar substantially disc-shaped arrays arranged parallel to and facing each other, and wherein at least one of the dynode arrays forms part of the vacuum envelope of the device.

6. A photomultiplier comprising a plurality of discrete dynodes arranged in cascade so that the second and any subsequent dynodes each receive electrons from the preceding dynode, the dynodes being of curvilinear cross-section and arcuate in extent about a common axis, successive dynodes being disposed so that the cascade extends radially relative to said axis, wherein the dynodes are arranged in two coaxial substantially planar substantially disc-shaped arrays arranged parallel to and facing each other, the photomultiplier further comprising an annular, part-annular or segmented anode for receiving electrons from the last dynode, and wherein the anode is disposed between the dynode arrays.

* * * * *